US005967833A

United States Patent [19]

Cachina

[11] Patent Number: 5,967,833

[45] Date of Patent: Oct. 19, 1999

[54] CIRCUIT CONNECTOR WITH MULTIPLE CONTACTS AND BUILT IN STRAIN RELIEF

[75] Inventor: Joseph S. Cachina, Warwick, R.I.

[73] Assignee: North American Specialties Corporation, Flushing, N.Y.

[21] Appl. No.: 08/992,493

[22] Filed: Aug. 6, 1997

Related U.S. Application Data

[60] Provisional application No. 60/025,776, Aug. 20, 1996.

[51] Int. Cl.[6] ..... H01R 9/07

[52] U.S. Cl. ..... 439/499; 439/874

[58] Field of Search ..... 439/422, 399, 439/499, 494, 492, 874

[56] References Cited

U.S. PATENT DOCUMENTS

| | | | |
|---|---|---|---|
| 3,634,806 | 1/1972 | Fergusson | 439/494 |
| 4,776,803 | 10/1988 | Pretchel | 439/494 |
| 5,017,154 | 5/1991 | Matsuoka | 439/492 |

*Primary Examiner*—Steven L. Stephan
*Assistant Examiner*—Javaid Nasri
*Attorney, Agent, or Firm*—Darby & Darby

[57] ABSTRACT

A circuit board connector (10), such as for a flex circuit (20), which provides a solid and reliable contact termination between a flex circuit (20) and a connector. The flex circuit connector (10) includes multiple contact points (24, 26) for contacting each lead or trace on the flex circuit (20). The multiple contact points (24, 26) are provided along a common member (28) which also includes a strain relief mechanism (30) in between the multiple contact points (24, 26). The strain relief mechanism (30) may be provided in the form of a V-shaped bend in the material of the common member (28) connecting the multiple contact points (24, 26) together. The contact points (24, 26) used to join the flex circuit (20) and the connector (10) may be achieved using any combination of staple-like contact points or solder contact points. The addition of the strain relief mechanism (30) in between the contact points (24, 26) greatly enhances the termination between the flex circuit (20) and the connector (10). In this way, the termination is able to withstand a larger applied force without destroying the flex circuit/connector termination. Additionally, the use of solder contact points in conjunction with the strain relief mechanism (30) provides additional strength to the termination since the flex circuit material is not punctured using the staple-like contact points.

21 Claims, 2 Drawing Sheets

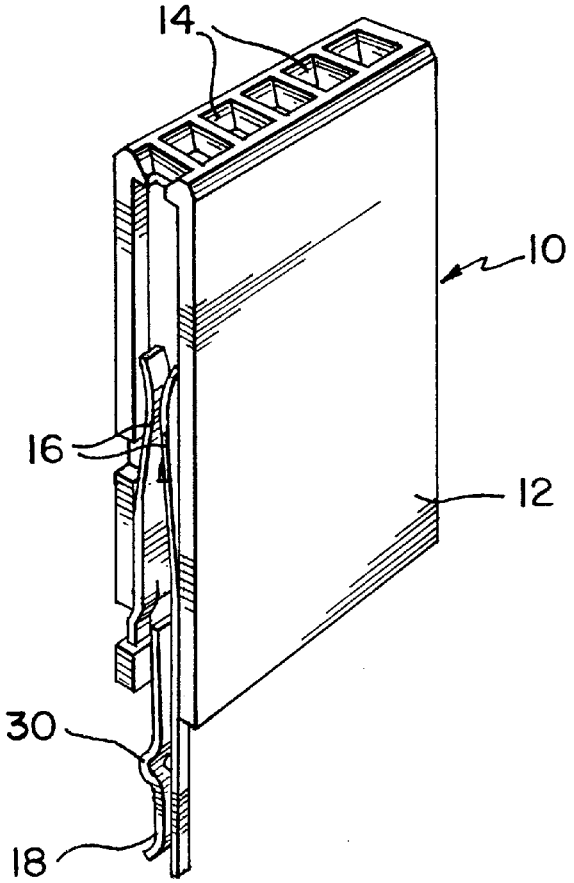
FIG. 1
FIG. 2
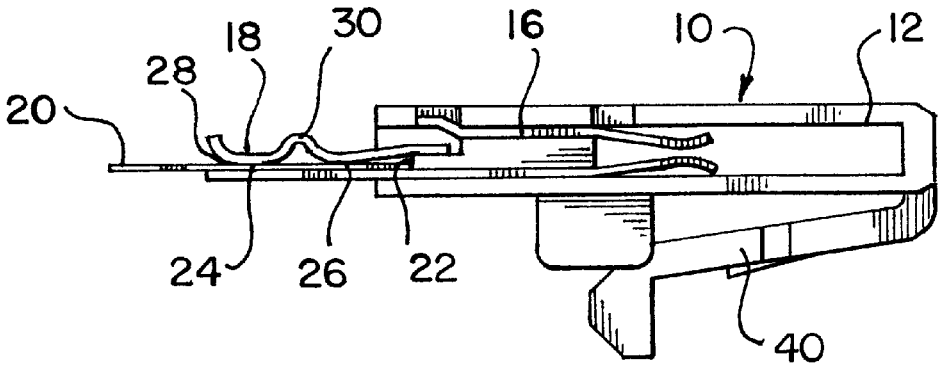

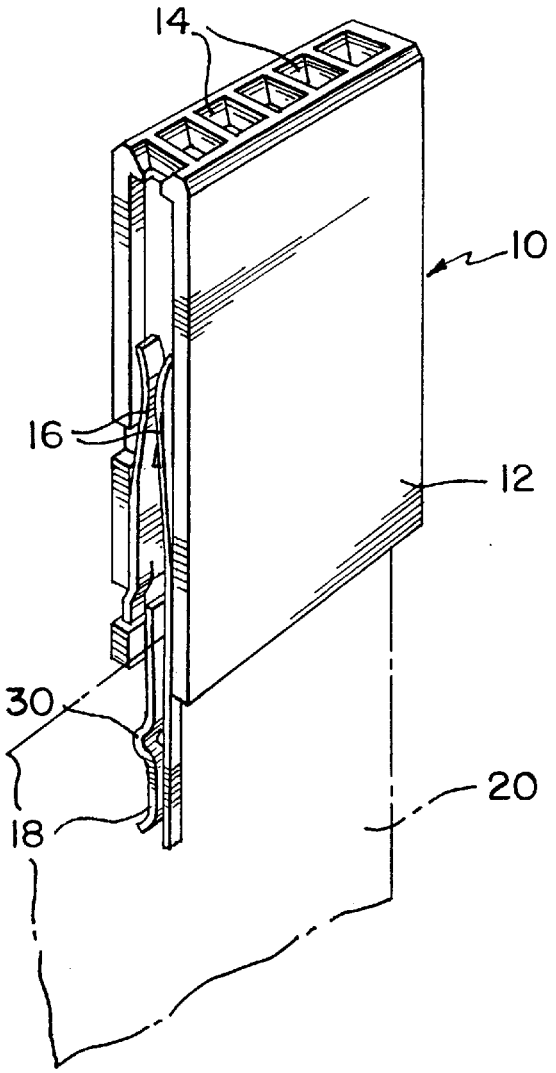
FIG. 3
FIG. 4
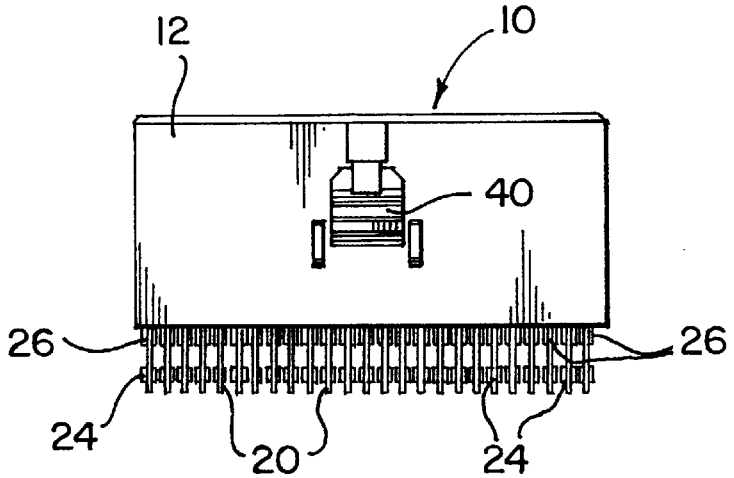

CIRCUIT CONNECTOR WITH MULTIPLE CONTACTS AND BUILT IN STRAIN RELIEF

The enclosed application is based on Provisional Patent Application Ser. No. 60/025,776, filed on Aug. 20, 1996. Applicant claims the benefit of the filing date of the aforesaid Provisional Application under 35 USC § 119(e)(1).

FIELD OF THE INVENTION

The present invention generally relates to the field of circuit board connectors. Specifically, the present invention relates to a connector for a circuit board, such as a flexible (flex) circuit, wherein the connector is provided with multiple contacts for contacting the flex circuit, along with a built in strain relief for reducing the possibility that the circuit board becomes disengaged from the connector upon the application of force to either the circuit board or the connector.

BACKGROUND OF THE INVENTION

Circuit boards are commonly used to interconnect electrical, as well as electromechanical, components with each other. Typically, the circuit board is provided with a number of traces of conductive material connecting one component to the other. For example, when interconnecting integrated circuit components, electrical traces are provided from a pin of one component to a pin of another component. The conductive traces on the circuit board are typically overlaid with an insulating material to protect the conductive trace, as well as to prevent inadvertent electrical contact between the conductive trace and any other electrical signal present on or near the circuit board. Circuit boards are oftentimes provided with multiple layers of conductive traces and insulating material to allow for the placement of more conductive traces on the circuit board, i.e., denser layout and interconnection. These "multilayer" boards allow a conductive trace in one plane to cross over or under another conductive trace in another plane (separated by the insulating material) without making electrical contact. In this way, the two traces remain electrically isolated.

Circuit boards may be made from any of a number of rigid or flexible materials. Rigid circuit boards provide mechanical stability and rigidity in that the components which are mounted to the circuit board are mounted and affixed to a rigid structure which is capable of withstanding the application of a certain amount of force without damaging the interconnection between the component and the circuit board. This is particularly crucial in the case of connectors used to interconnect the circuit board with other circuit boards or components. The components on the circuit board are typically soldered in place upon initial installation. This type of interconnection is sufficiently strong and typically able to withstand the subsequent application of force without compromising the solder connection. However, in the case of connectors, the connectors are intended to allow multiple connection/disconnection with other devices. When used with rigid circuit boards, connectors are typically soldered to the circuit board, and thus, are able to withstand the force applied to the connector during the connection/disconnection with other devices.

Conductive traces on flex circuits are typically provided by photolithographically patterning the conductive traces using a conductive ink, such as silver. Several methods have been devised for providing electrical and mechanical contact between the conductive traces on a flex circuit and other devices. One such approach dispenses with the need for a connector altogether. Instead, the flex circuit is provided with a "tail" section, i.e., a narrowed or necked-down section providing electrical contact with the conductive traces on the flex circuit. The "tail" section is then inserted into a receptacle or connector on the device which to be contacted with the flex circuit. While this approach eliminates the need for a connector on the flex circuit, and the associated problems with mounting a connector to the flex circuit, it nevertheless suffers from several disadvantages. Primarily, the "tail" section of the flex circuit is still made from the same flexible material used to fabricate the flex circuit itself, and as a result, the "tail" section does not possess the required structural rigidity needed for inserting the "tail" section into the target connector or receptacle. Although insertion of the "tail" section is still possible, repeated insertions and handling of the "tail" section oftentimes results in damage to the "tail" section.

An alternative approach to the use of the "tail" section to provide interconnection with other devices is the use of a connector mounted to the flex circuit itself. The connector provides sufficient rigidity in connecting with other devices. However, the secure mounting of connectors to flex circuits presents additional problems, even beyond those encountered with rigid circuit boards. Because flex circuit are commonly made from a very thin and flexible material such as plastic, the connector/flex circuit interface must be able to withstand the application of force, and it must be able to do so without damaging the relatively fragile material of the flex circuit itself.

One approach to mounting connectors to flex circuits involves the use of staples or other fastening devices to hold the connector and flex circuit together. In this type of connection, the contacts of the connector are aligned with the conductive traces on the flex circuit. Next, staple-like devices are inserted over each contact and each conductive trace. The staple-like devices puncture the flex circuit material and are then clamped down to hold the contact and conductive trace together, thereby providing electrical and mechanical connection between each contact and each conductive trace. The use of these staple-like devices does not provide adequate immunity against tearing of the flex circuit material whenever any force is applied to the flex circuit/connector interface. Rather, the use of staple-like devices actually increases the susceptibility to flex tearing by introducing holes in the flex circuit which negatively affect the integrity of the flex circuit material.

As discussed above, the use of staple-like devices results in low reliability contact terminations. Additionally, the use of staple-like devices is a complex and labor intensive assembly process. Further, this approach does not lend itself to easy visual inspection, since, liter alia, both the top and bottom surfaces of the flex circuit must be viewed in order to ascertain the integrity of the connection.

OBJECTS OF THE INVENTION

It is an object of the present invention to provide a solid and reliable contact termination between a circuit board, such as a flex circuit board, and a connector.

It is an additional object of the present invention to provide a simple and repeatable method for terminating a circuit board, such as a flex circuit, with a connector, which also allows easy visual inspection of the termination.

SUMMARY OF THE INVENTION

The present invention is for a circuit board connector which provides a solid and reliable contact termination between a circuit board and a connector. The circuit board connector includes multiple contact points for contacting each lead or trace on the circuit board. The multiple contact points are provided along a common member which also includes a strain relief mechanism in between the multiple contact points. The strain relief mechanism may be provided in the form of a V-shaped bend in the material of the common member connecting the multiple contact points together. The contact points used to join the circuit board and the connector may be achieved using any combination of staple-like contact points or solder contact points. The addition of the strain relief mechanism in between the contact points greatly enhances the termination between the circuit board and the connector. In this way, the termination is able to withstand a larger applied force without destroying the circuit board/connector termination. Additionally, the use of solder contact points in conjunction with the strain relief mechanism provides additional strength to the termination since the circuit board material is not punctured using the staple-like contact points.

BRIEF DESCRIPTION OF THE DRAWINGS

Other objects, features and advantages of the invention discussed in the above brief explanation will be more clearly understood when taken together with the following detailed description of an embodiment which will be understood as being illustrative only, and the accompanying drawings reflecting aspects of that embodiment, in which:

FIG. 1 is a perspective view of a flex circuit connector according to the present invention;

FIG. 2 is a side elevational view of a flex circuit connector according to the present invention;

FIG. 3 is a perspective view of a flex circuit connector according to the present invention when the connector is mated with a flex circuit; and FIG. 4 is a bottom elevational view of a flex circuit connector according to the present invention.

DETAILED DESCRIPTION OF THE PREFERRED EMBODIMENTS

Referring now to FIG. 1, therein is shown a connector 10 in accordance with the present invention. The present invention will be described by way of example to a flex circuit board. However, it should be understood that the present invention is applicable to various types of circuit boards in general, such as rigid circuit boards and flex circuit boards. The connector 10 includes a housing 12 having a number of openings 14 for receiving a cable (not shown) or other device for establishing electrical contact with another device. The detailed construction and use of this aspect of the connector are well known to those of ordinary skill in this field, and therefore, need not be set forth in detail herein.

The connector 10 includes a number of dual beam receptacle contacts 16, one for each opening 14. Accordingly, the number of receptacle contacts 16 is equal in number to the number of openings 14 in connector 10. Each receptacle contact 16 is designed to engage a pin or wire (not shown) inserted into each opening 14. At the end of the connector 10 opposite the end containing the openings 14 are a number of strain relief contacts 18, with only one exemplary contact being shown in FIG. 1. A strain relief contact 18 is provided for each opening 14 and receptacle contact 16. Connector 10 is also provided with an optional locking latch 40 (FIG. 2) similar to that found on a standard RJ-11 telephone jack for providing ready insertion/removal to/from a target device.

Referring now to FIG. 2, therein is shown the connector 10 mated with a flex circuit 20. The flex circuit 20 is inserted into the connector at the end shown until a positive stop 22 or other similar registration mechanism is engaged. The flex circuit is inserted and held between one leg of the receptacle contact 16 and the strain relief contact 18. The strain relief contact 18 is provided with two separate contact points 24, 26 for contacting the flex circuit 20. The contact points 24, 26 are provided along a common member 28. The strain relief contact 18 is also provided with a strain relief mechanism 30 adjacent to and in between contact points 24, 26. In the embodiment shown in FIG. 2, the strain relief mechanism 30 is provided in the form of a V-shaped or arcuate bend in the common member 28 on which are provided the contact points 24, 26.

Contact points 24, 26 are provided using either staple-like devices, as described above, or using solder contacts. The presence of the strain relief member in between the contact points 24, 26 greatly enhances the ability of the connector 10 joined to the flex circuit 20 to withstand the application of a certain amount of force without destroying the termination between the connector 10 and the flex circuit 20. In the case of solder contacts, the solder is melted using localized or generalized heat applied to the solder area of the contact. The advantage of using solder contacts is that once the solder is melted to join the connector 10 and flex circuit 20 together, the solder joints are located on the same side of the flex circuit and are fully open to inspection.

The reason for the improved performance of the connector according to the present invention is best understood in connection with FIG. 4. As shown in FIG. 4, connector 10 includes a row of contact points 24 and a row of contact points 26. The length (i.e., the number of elements) of each row is the same and corresponds in number to the number of openings 14 in the connector 10. Whenever any force is applied to connector 10 after it is joined with flex circuit 20, the force acts on the contact point 26. The corresponding contact point 24 is buffered by the presence of the strain relief mechanism in between the contact points 24, 26 and therefore is generally not subject to any of the applied force. The force also acts on the other contact points 26 along the same row. None of the contact points 24 would experience the applied force due to the presence of the strain relief mechanism 30. For any contact point 24 to begin to experience the applied force, all of the contact points 26 along the row must have first failed. This is typically unlikely to occur. In the event that a single contact point 26 were to fail, the corresponding contact point 24 would still be intact and would provide the necessary contact between the flex circuit 20 and the connector 10. In this event, the applied force would still be spread over the row of contact points 26.

The improved performance of the connector 10 of the present invention may also be understood by way of a comparison with conventional connectors not provided with a strain relief mechanism. Although the use of multiple contact points for each electrical conductor improves the reliability of the connector, the lack of a strain relief mechanism still results in some unreliability. In a conventional connector with multiple contact points per conductor, any applied force will be distributed over the multiple contact points. This approach provides improved performance over a single contact point per conductor approach. The addition of a strain relief mechanism in between the multiple contact points, as contemplated by the present invention, provided even better performance in that the applied force is now distributed along the entire row of first contact points 26, leaving the second row of contact points 24 in tact.

While the invention has been particularly shown and described with reference to a preferred embodiment thereof, it will be understood by those skilled in the art that various changes in form and details may be made therein without departing from the spirit and scope of the invention. The present invention is applicable in general to various types of circuit boards, including rigid circuit boards as well as flex circuit boards.

I claim:

1. A connector for establishing electrical communication between at least one external conductor and at least one circuit conductor on a circuit board, the connector comprising:

at least one strain relief contact including a plurality of contact points disposed along a common member for substantially fixed contact with said circuit conductor to provide electrical and mechanical contact therewith, said strain relief contact further including a strain relief mechanism comprising a segment of the common member disposed between the plurality of contact points; and at least one electrically conductive contact connected to a corresponding one of said at least one strain relief contacts, said contact adapted to connect to one of the at least one external conductors, whereby when said strain relief contact contacts said circuit conductor and said contact is connected to said external conductor, electrical communication is established between said external conductor and said circuit conductor.

2. The connector of claim 1 wherein:

said contact comprises a pair of spaced apart, opposing contact beams for receiving said external conductor therebetween to connect with said external conductor.

3. The connector of claim 1 further comprising:

a housing for containing at least a portion of said at least one strain relief contact and said at least one contact therein, said housing being formed with at least one opening in substantial alignment with said at least one contact and dimensioned for extension of said external conductor therethrough to connect with said contact.

4. The connector of claim 1 for connecting a plurality of said external conductors to a plurality of said circuit conductors on said circuit board and further comprising:

a plurality of said strain relief contacts disposed at spaced locations and adapted to contact respective circuit conductors to provide mechanical and electrical contact therewith; and a plurality of said electrically conductive contacts correspondingly connected to said strain relief contacts and adapted for connection with the respective external conductors.

5. The connector of claim 1 wherein:

said plurality of contact points project outwardly to define a common plane for contact with said flex circuit conductor; and said strain relief mechanism comprises a segment of said common member spaced from said common plane to remain out of contact with said circuit conductor.

6. The connector of claim 1 wherein:

said strain relief contact comprises a pair of spaced apart contact points on said common member for contact with said circuit conductor, and further comprises a generally V-shaped strain relief mechanism interposed between said contact points.

7. The connector of claim 3 wherein:

said housing includes a first end formed with an opening for insertion of said circuit therein and further including an internal stop disposed within said housing at a predetermined location therein for abutting relationship with said circuit to limit the extent to which said circuit may be inserted into said housing.

8. The connector of claim 3 for releasable engagement with a target device and further including:

a locking latch mounted on said housing and operative to releasably engage said housing with said target device.

9. The connector of claim 1, wherein said circuit conductors comprise flex circuit conductors.

10. A circuit connector for establishing electrical communication between a plurality of external conductors and a circuit including a plurality of circuit conductors, the connector comprising:

a plurality of strain relief contacts adapted for connection with the respective circuit conductors, each said strain relief contact including a plurality of contact points provided along a common member for substantially fixed contact with the respective circuit conductor to provide electrical and mechanical contact therewith, each said strain relief contact further including a strain relief mechanism interposed between each plurality of contact points; and a plurality of contacts electrically connected to the corresponding strain relief contacts, each said contact adapted to connect to one of said external conductors.

11. The circuit connector of claim 10 wherein:

each said contact comprises a pair of spaced apart, opposing contact beams configured to receive a corresponding one of the external conductors therebetween.

12. The circuit connector of claim 10 further including:

a housing for containing at least a portion of the strain relief contacts and the contacts therein, said housing being formed with a plurality of openings in substantial alignment with the respective contacts and dimensioned for extension of said external conductors through the respective openings to engage the respective contacts.

13. The circuit connector of claim 10 wherein:

said plurality of contact points project outwardly for contact with the respective circuit conductors and define a common plane; and said strain relief mechanisms are in the form of segments of said common members spaced from said common plane to remain out of contact with said circuit conductors.

14. The circuit connector of claim 10 wherein:

each said strain relief contact comprises a pair of spaced apart contact members on said common member and a generally V-shaped strain relief mechanism interposed therebetween.

15. The circuit connector of claim 12 wherein:

said housing includes a first end formed with an opening sized to receive said circuit and further including an internal stop disposed at a predetermined location within said housing for abutting relationship with said circuit to limit the extent to which said circuit may be extended into said housing.

16. The circuit connector of claim 12 for releasable engagement with a target device and further including:

a locking latch mounted on said housing and operative to releasably engage said housing with said target device.

17. The circuit connector of claim 13, wherein each of said segments includes an arcuate portion.

18. A method of connecting a plurality of external conductors to a plurality of flex circuit conductors of a flex circuit, the method comprising the steps of:

selecting a flex circuit connector comprising a plurality of strain relief contacts, each of which includes a plurality of contact points provided along a common member, each said strain relief contact further including a strain relief mechanism interposed between the respective contact points, said flex circuit connector further comprising a plurality of contacts electrically connected to the respective strain relief contacts;

connecting the contact points of the respective strain relief contacts with the respective flex circuit conductors to provide electrical and substantially fixed mechanical contact therewith; and connecting the respective contacts with the respective external conductors to provide electrical and mechanical contact thereto and to establish electrical communication between the respective external conductors and the respective flex circuit conductors.

19. The method of claim 18 wherein:

said step of connecting the contact points includes the step of soldering the contact points to the respective flex circuit conductors.

20. The method of claim 18 wherein:

said step of connecting the contact points includes the step of stapling the contact points to the respective flex circuit conductors.

21. A flex circuit connector for connecting external conductors to a flex circuit, the connector comprising:

at least one strain relief contact adapted to receive a flex circuit conductor for providing electrical and mechanical contact thereto, said strain relief contact including a plurality of contact points provided along a common member, said strain relief contact further including a strain relief mechanism provided in an area located in between the plurality of contact points, said contact points adapted to provide electrical and substantially fixed mechanical contact to said flex circuit conductor; and at least one contact connected to a corresponding one of said at least one strain relief contact, said contact adapted to connect to an external wire.

* * * * *